US006184427B1

(12) United States Patent
Klepfer et al.

(10) Patent No.: US 6,184,427 B1
(45) Date of Patent: Feb. 6, 2001

(54) PROCESS AND REACTOR FOR MICROWAVE CRACKING OF PLASTIC MATERIALS

(75) Inventors: James S. Klepfer, Greenville, NC (US); Travis W. Honeycutt, Gainesville, GA (US); Viktor Sharivker, Ottawa; Gulshen Tairova, Cobourg, both of (CA)

(73) Assignee: Invitri, Inc., Greenville, NC (US)

( * ) Notice: Under 35 U.S.C. 154(b), the term of this patent shall be extended for 0 days.

(21) Appl. No.: 09/273,245

(22) Filed: Mar. 19, 1999

(51) Int. Cl.[7] ..... C07C 1/00
(52) U.S. Cl. ..... 585/241; 201/2.5; 201/25
(58) Field of Search ..... 585/241; 201/2.5, 201/25

(56) References Cited

U.S. PATENT DOCUMENTS 4,118,282 * 10/1978 Wallace ..... 201/2.5
4,279,722 * 7/1981 Kirkbride ..... 204/162 R
5,744,668 * 4/1998 Zhou et al. ..... 585/241

* cited by examiner

*Primary Examiner*—Bekir L. Yildirim
(74) *Attorney, Agent, or Firm*—Malcolm B. Wittenberg

(57) ABSTRACT

A process of activated cracking of high molecular organic waste material which includes confining the organic waste material in a reactor space as a mixture with a pulverized electrically conducting material (sensitizer) and/or catalysts and/or "upgrading agents" and treating this mixture by microwave or radio frequency electro-magnetic radiation. Organic waste materials include hydrocarbons or their derivatives, polymers or plastic materials and shredded rubber. The shredded rubber can be the source of the sensitizer and/or catalyst material as it is rich in carbon and other metallic species. This sensitizer can also consist of pulverized coke or pyrolytically carbonized organic feed-stock and/or highly dispersed metals and/or other inorganic materials with high dielectric loss which absorb microwave or radio frequency energy.

19 Claims, 6 Drawing Sheets

PROCESS AND REACTOR FOR MICROWAVE CRACKING OF PLASTIC MATERIALS

TECHNICAL FIELD OF THE INVENTION

Figure 1A:
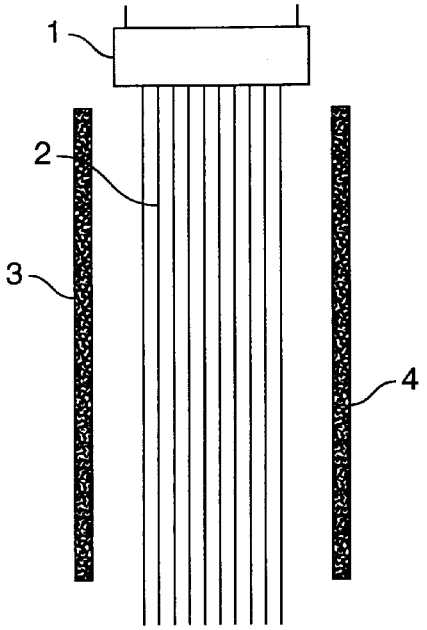

The present invention deals with the treatment of various hydrocarbons and other polymers such as plastics which currently are disposed of in landfills and other waste disposal facilities in order to convert such materials to relatively clean burning sources of energy. Hydrocarbons such as bunker and sludge oils, polyesters, polyethylenes, polypropylenes and styrenes can be processed by subjecting them to hydrocarbon cracking through the use of microwaves using sensitizers in order to lower their molecular weights and, consequently, convert them to convenient liquid and gas sources of energy which are more easily and cleanly transported and burned.

BACKGROUND OF THE INVENTION

The vast majority of mixed plastics generated by consumers are disposed of in landfills, despite the fact that breakdown of these materials by natural degradation is an extremely long process. The idea of recycling mixed plastics using current technologies is not economically attractive. In addition, challenges of impurities and cross-contamination among the resin types are formidable.

It is possible to incinerate mixed plastics to recover energy. However, it has not been possible to do so in a controlled manner that reduces off-gas pollution to desirable standards. In order to discourage the practice, some regulators in Europe have elected to stipulate that energy from plastic fuel is non-renewable although energy from other waste and biomass fuel is considered renewable.

It is the goal of the present invention to provide a technology that economically converts mixed plastic into a liquid or gaseous low molecular weight fuel without generation of significant air pollution. In performing this invention, users would experience a reduction in landfill burdens together with a new clean burning fuel source and, potentially, valuable chemical co-products at commercial purity levels.

Plastics and municipal solid waste are major obstacles to eventual restoration of contaminated land. The practice of selecting for recycle only a few component types and removing only the most accessible portion reduces prospects for a solution. It is an object of this invention to provide low bulk temperature processing of waste plastics and similar hydrocarbons which is devoid of the generation of toxic off-gases which heretofore has belied an economic solution. It is a further notion that by employing technology of the present invention, waste plastics can be processed at small scale at electric power generators dispersed within various communities. In other words, this technology can be employed for manufacturing oxygenated, low-sulphur fuels to be used in electric power generation from municipal plastic waste. The present invention employs a novel cascade of thermal and non-thermal mechanisms to break down large molecules and to separate sulphur, nitrogen, halogen and metal contaminants. Proprietary catalysts and sensitizers accelerate the reactions. This process is preferably conducted in the absence of elemental oxygen or in a starved oxygen atmosphere (i.e., less than 2%) so that oxygenated pollutants are not emitted. Avoiding incineration and the high temperatures associated with pyrolysis allows high selectivity and formation of favored liquid hydrocarbons with simple removal of some contaminants before combustion to generate process heat and subsequent electric power. By-product solids, carbon and inorganic compounds and catalysts produced by the inventive process are not hazardous and in the main can be reprocessed as renewed sensitizers.

CITATION OF PRIOR ART

The prior art has described pyrolytic and catalytic cracking processes of various high molecular weight hydrocarbon materials at high temperatures and in inert atmospheres with and without using microwave irradiation.

In U.S. Pat. No. 5,470,384 issued Nov. 28, 1995, Cha et al. disclose a two step thermal process for co-recycling scrap tires and waste with emphasis on the production of light oil, gas and carbonaceous material. A first stage includes the digestion of the mixture of tires and oils in an inclined screw reactor at 600–875° F. (315–468° C.). A second stage includes thermal treatment in a horizontal reactor at 800–900° F. (426–482° C.). Addition of CaO improved the quality and value of the product by decreasing its aromatic carbon, sulphur and oxygen content and specific gravity.

In U.S. Pat. No. 4,983,278, issued Jan. 8, 1991, Cha et al. describes a process for obtaining light oil by pyrolysis of oil shale, scrap tires, waste oil and tar sands using a horizontal and inclined screw pyrolysis reactor and inclined fluid bed combustor. The maximum oil yield was found with a pyrolysis temperature 752° F. (400° C.).

In U.S. Pat. No. 5,464,503, issued Nov. 7, 1995, Avetisian et al. teach that there are unreacted components after the conversion of tires and waste oil into light oil by pyrolysis. The disclosure teaches that a screw pyrolysis reactor may be used for carrying out their tire liquefying process in order to convert unreacted hydrocarbon components to a liquid. In this process an oil/metal mixture is heated by a pyrolysis reactor to a temperature 900–1500° F. (480–815° C.) sufficient to convert unreacted hydrocarbon components to a liquid and gas.

In U.S. Pat. No. 4,347,120 issued Aug. 31, 1982, Anderson et al. disclose the process of the upgrading heavy hydrocarbons by cracking with hydrogen donor diluent. However, it is necessary to operate at temperatures of 1300–1500° C. in order to reduce sulphur levels so the product can be used as fuel.

In U.S. Pat. No. 4,329,221, issued May 11, 1982, Parcasiu et al. teach a process for reducing metal, nitrogen and sulphur content of petroleum residual oils using hydrogen-donor solvent with a catalyst. Manganese nodules which were heated to 800° F. (426° C.) were used for the catalytic desulfurization, demetalation and denitrogenation of hydrocarbon feedstocks.

In U.S. Pat. No. 5,602,186 issued Feb. 11, 1997, Myers et al. describes a process for desulfurization of rubber by mixing tire crumb with molten alkali metal before or during the devulcanization reaction. The reaction which includes the formation of alkali sulphide is extremely exothermic and must be performed in an autoclave.

All of the prior art cited above used pyrolysis processes for the conversion of polymers to light hydrocarbons at temperatures not lower than 752° F. (400° C.). They describe pyrolytical processes which require high bulk temperature, relatively expensive equipment and/or highly corrosive and explosive materials like alkali metals. In order to overcome the deficiencies of the above mentioned prior art, microwave irradiation may be employed for the catalytic conversion of high molecular weight organic materials in order to produce light hydrocarbon molecules.

In U.S. Pat. No. 4,505,787 issued Mar. 19, 1985, Fuller and Lewis teach that microwave energy can be used to produce a carbide by reaction between carbon and calcium oxide at elevated temperatures. Carbon is used to conduct heat under microwave irradiation to other reactants. It can be combined with the Hall-Heroult process to produce aluminum and carbon dioxide.

In U.S. Pat. No. 5,451,302 issued Sep. 19, 1995, Cha discloses a process using microwave energy to catalyze chemical reactions in a liquid phase, which includes the concentration of phosphoric acid by removal of bound water and the release of carbon dioxide from solutions of monoethanolamine.

In U.S. Pat. No. 4,118,282 issued Oct. 3, 1978, Wallaces discloses the process and apparatus for destructive distillation of high molecular weight organic materials by using multiple wave energy sources including microwave and ultrasonic radiation and laser beams in the presence of elemental carbon or other microwave absorptive particles including aluminum silicate or metal. However, it was necessary to include an additional electrolysis unit in this process in order to remove "soot" and unreacted carbon from the products.

In U.S. Pat. No. 4,545,879 issued Oct. 8, 1985, Wan et al. teach that microwave irradiation can be used to desulphurize pulverized petroleum pitch in the presence of hydrogen and a ferromagnetic catalyst. This process allows the removal of up to 70% sulphur from the pitch.

In U.S. Pat. No. 4,148,614 issued Apr. 10, 1979, Kirkbride teaches that microwave irradiation can be used for decreasing the sulphur and oxygen content of coal in the presence of hydrogen.

In U.S. Pat. No. 5,507,927 issued Apr. 16, 1996, Emery discloses a method and apparatus for the non-pyrolytic and non-catalytic reduction of organic material using microwave radiation in a reducing atmosphere. A parabolic wave guide was suggested for creating a uniform distribution of irradiation. It is claimed that the typical process can be carried out at temperatures of about 350° C. (662° F.).

In U.S. Pat. No. 4,749,470 issued Jun. 7, 1988 Herbst et al. disclose a process and apparatus for fluid catalytic cracking which includes the mixing of the residuum, preheated by microwave radiation to a temperature up to 593° C. (1100° F.), with reactive compounds. Reactive compounds were formed separately by contacting the fluid catalytic cracking catalysts and a light hydrocarbon stream in a conduit at 649–871° C. (1200–1600° F.).

In U.S. Pat. No. 5,364,821 issued Nov. 15, 1994, Holland teaches that activated carbon can be produced from carbon filled rubber materials by using microwave discharge such that the material attains a temperature 800° C. (1472° F.). Sulphur and metal are removed from the pyrolysed product by acid washing.

In U.S. Pat. No. 4,279,722 issued Jul. 21, 1981, Kirkbride describes how to use microwaves for petroleum refinery operations. The process involves catalytic operation for conversion of liquid hydrocarbons by applying microwave energy to the hydrocarbons in contact with a platinum catalyst in presence of hydrogen.

None of the known prior art teaches the formation of electrical discharges using microwave catalytic activation which in turn forms free radicals and extrusion of hydrocarbon feed in mixture with catalysts for the conversion of polymers, including various plastics, tires, waste oil, and related components into light hydrocarbon fuel.

SUMMARY OF THE INVENTION

The present invention deals with a novel method for the preparation of relatively clean, low sulphur fuel from hydrocarbon sludges and waste plastics and paper including used automobile tires. The technology embraces the use of wave physics including microwave and radio frequency irradiation. The chemistry involves RF frequencies to heat and dissolve materials and pulsed microwave wave frequencies in combination with catalysts which generate electrical micro discharges on the catalyst surface which generate free radicals which in turn initiate the cracking of hydrocarbons and waste plastics into smaller molecular weight entities. Cracking reduces the very large molecular weight hydrocarbons to low molecular weight fuel that has a lower viscosity with enhanced flow which in turn enables the fuel to more easily vaporize and atomize for a clean, efficient burn.

DETAILED DESCRIPTION OF THE INVENTION

As noted previously, the present invention is intended to employ the principles of wave physics including microwave and radio frequency irradiation and/or electron beam bombardment in order to crack hydrocarbons and waste plastics into smaller molecular weight entities.

The processes of hydrocarbon thermal cracking and depolymerization are endothermic and involve free-radical chain reactions. The energy required for the process is supplied as heat or can be provided by electromagnetic irradiation. The microwave activated cracking process has a different mechanism for the initiation stage of free radical chain reactions as compared to thermal cracking. Although microwave activated cracking of liquid hydrocarbons usually requires the presence of a catalyst/sensitizer, it does not necessarily proceed through the stages of chemisorption of the reagents on the catalytic surface and formation of intermediate compounds with the catalyst.

Microwave technology is relatively new in chemical industry and especially in recycling.

The major advantages of the microwave processing are as follows:

Microwave technology is environmentally friendly; there is no toxic or $CO_2$ emission related to the heating process since the microwave energy is produced from electricity.

Microwave energy can be delivered directly to the reacting or processing species by using their dielectric properties or by adding absorbing material (sensitizer) which converts electromagnetic energy into heat.

Microwave heating eliminates the restrictions of conventional heating related to thermal conductivity and heat transport. The reactor contents can be heated to high temperatures in a relatively cold reactor. The heating rate can be several orders of magnitude greater than with conventional heating.

In addition to thermal heating, microwave treatment can stimulate the processed material by non-thermal effects (high electric or magnetic field effects, electron impact and ionization, electric discharges and plasma, etc.).

Microwave generators may be included in a feedback loop of an automated process and quickly respond to changes in process parameters or emergency conditions.

Cracking of gaseous hydrocarbons in an electric arc or high frequency electromagnetic discharge is a well-known plasma-chemical process. In plasmas at a pressure greater than $10^2$ torr, the temperature of non-ionized molecules and ions is very high due to excitation by accelerated electrons and energy redistribution between the molecules. Due to electron impact and high temperature, the organic molecules dissociate to free radicals and atoms with subsequent recombination into products with the lowest free energy. The most stable products under these conditions are hydrogen, carbon and acetylene. However, in the presence of a catalyst, more valuable products can be formed from free radicals generated in the plasma discharge.

Another way to transfer the electromagnetic energy to non-absorbing organic molecules is to use sensitizers. Electromagnetic energy can be absorbed by sensitizers, which comprise solid materials with moderate electrical conductivity, and this energy is then transferred to the organic molecules which exhibit low dielectric loss characteristics. In this case, the conduction electrons in the sensitizers are accelerated in the oscillating electric field and dissipate the kinetic energy as heat. When the thickness of the conducting material is small and comparable with the penetration depth of the electromagnetic irradiation, its surface becomes hot. Under these conditions, the electrons can be emitted from the material and accelerated in the electric field causing arcing and electric discharges.

The efficiency of microwave absorption depends on the electronic structure of the materials involved. The electrical conductivity provides a major contribution to the dielectric loss. However, bulk metals with a high electrical conductivity are not good sensitizers and absorbers of the microwave energy because the penetration depth of the electric field in such materials is of the order of $10^{-6}$ m. Most of the incident electromagnetic wave is reflected from good conductors and dielectrics poorly interact with microwaves since their electrical conductivity is very low. The best absorbers of microwave energy have moderate electrical conductivity and consist of activated or amorphous carbon, amorphous or highly dispersed metals, or transition metal oxides and salts. Such materials can be used as sensitizers for microwave activation of the reactions of hydrocarbons.

Another characteristic of sensitizers for use herein is that this kinetic energy of their conduction electrons is proportional to the magnitude of the electric field and to the length of acceleration. Therefore, it is preferable to align the sensitizer in parallel with the electric field and to place it in the area of maximum field density. The most effective sensitizers consist of thin conductive layers or oriented fibers. In many cases, good results in the contemplated microwave activated cracking process can be obtained with highly dispersed materials such as amorphous metals supported by porous substrates having high surface areas (activated carbon, silica or alumina). Simultaneously by providing heat due to dielectric loss, these materials act as catalysts for the reactions.

Depending on the power density in the electromagnetic field and characteristics of the catalyst or sensitizer (i.e., composition, structure, density, and orientation), there are two major mechanisms for microwave catalysis, namely, thermal activation and plasma microdischarges.

With a relatively low density of the electromagnetic field and/or high boiling temperature organic medium, microwave absorption gives rise to an increase in the surface temperature of the sensitizer and activates chemical reactions including catalytic reactions on the surface of sensitizer. Mass transport of the reagents and products near the sensitizer is determined by their diffusion and the waveform of microwave irradiation.

It was noted that dielectric loss in plastic materials is usually small since most of them are dielectrics. The dielectric loss of a plastic/sensitizer composite is mainly determined by the addition of a strongly absorbing sensitizer and depends on the material used as a sensitizer (individual dielectric constants, composition, shape, size and orientation of the particles, concentration, etc.). Since the matrix (plastic material) does not absorb microwaves, the dielectric characteristics of a solid or molten composite are not sensitive to the polymer type. The dielectric characteristics will change with the temperature and with the conversion since the residue from the cracking process contains coke and highly conjugated molecules which will contribute to electrical conductivity of the material at the microwave and radio frequencies and therefore change the effective loss factor.

Penetration depth is an important parameter in microwave heating. This parameter shows how deep the electromagnetic power penetrates into the material. The penetration depth in the plastic/sensitizer composites used herein for microwave cracking should be of the order of 5 to 10 mm, which is achieved by an empirical adjustment of the concentration of the sensitizer. At a high concentration of sensitizer, the penetration depth is small and most of the microwave/radio frequency power is absorbed in a thin surface layer, the depth of which could be less than 1 mm, depending on the material and concentration of the added sensitizer. In this case, only the outer layer of the processed material is heated to high temperature. The temperature profile is highly non-uniform because of a low thermal conductivity of the plastics. The cracking reaction takes place only in the surface layer. At a low concentration of the sensitizer, the penetration depth of electromagnetic energy is high (a few centimeters or more, depending on the concentration). The temperature profile is more uniform. However, the absorbed microwave power is significantly lower in this case, resulting in a lower temperature of the processed material and lower reaction rate. The mass transport of the cracking products to the surface of the processed material is slowed due to a greater traveling distance from deep layers. With the high penetration depth (low effective loss factor), the electromagnetic power is used inefficiently and a considerable fraction of the incident power is not absorbed.

When the local density of electromagnetic field exceeds a breakdown threshold due to a high level of the applied power and specific orientation of the sensitizer, local microwave discharges may develop in the gas/vapor phase. Due to coupling with the microwaves, additional absorption of the microwave power by the plasma micro-discharges causes generation of free radicals. Depending on the conditions, the free radicals recombine in the gas/vapor phase and on the surface of the catalyst/sensitizer and form products. The material of the sensitizer may take part in the reaction. For example, it was found in a study of microwave and radio frequency activated reaction of methane over carbon that the carbon atoms from the sensitizer (activated carbon) takes part in the formation of acetylene molecules. The chemical participation of the sensitizer in formation of the products was due to breaking the hydrogen molecules into atoms and their subsequent reactions with the carbon atoms on their surfaces.

When the processed material consists of a low-temperature boiling liquid such as a light hydrocarbon, which do not absorb microwave energy, the composition, placement and shape of the sensitizer are critical for the development of hydrocarbon cracking. It was found that with conducting fiber sensitizers placed in parallel with the electric field, microdischarges are developed in the liquid phase near the fibers. The discharges could be generated at a relatively low density of the electromagnetic field (for example, at a power level of 60 W with a single mode cavity of a 100 $cm^3$ effective volume, or at a power of 600 W with a multimode cavity of a 10 L effective volume).

The nature of the microdischarges in liquid hydrocarbons is not entirely understood. It could be related to the boiling process of the liquid near the surface of the sensitizer, in particular, the phase transition from liquid to gas/vapor during bubble formation. Due to a high local density of the created electromagnetic field near the fibers, microdischarges can be initiated which absorb the microwave power. Such discharges are highly non-equilibrium since the walls of the bubbles consisted of a liquid at the boiling temperature, i.e. significantly lower than the temperature of plasma in the discharge. As a result, the intermediate C2 and C3 products can be quenched on the bubble walls instead of converting to carbon, hydrogen and acetylene which are more stable thermodynamically but less valuable than ethylene and propylene.

With a viscous organic liquid such as one composed of molten plastics, both a thermal activation mechanism and plasma microdischarges will contribute to the cracking process. It could be expected that, due to the higher viscosity and higher boiling temperature, the "cage effect" will play a more important role in the free radical recombination in such a system. In addition, removal of the products formed near the catalyst/sensitizer will be slowed down so that they will remain in the hot zone longer and undergo further decomposition and secondary reactions. Therefore, attention must be paid in the technology for microwave plastics processing to providing efficient means for the product removal. The processed material should be as thin as possible and the sensitizer should be dispersed and uniformly distributed through the material before microwave irradiation. Possible ways to accomplish this goal include extrusion of molten plastics or a blend of waste polymer materials in a form of "spaghetti" strands or thin sheets with high surface areas. In such cases, the gaseous or vapor products formed as a result of microwave activated cracking, will be delivered to the surface of the processed material with the generated gas bubbles and then removed from the reactor with a flow of carrier gas. The high surface area will provide a faster conversion of the feed and reduce the residence time and the contribution of secondary reactions. The heat transport through such a thin layer of "spaghetti" will be also facilitated.

As noted repeatedly above, the present invention requires the use of a suitable sensitizer or catalyst to carry out the contemplated commercial process for microwave activated cracking of waste plastics. There are a number of parameters which dictate the appropriate sensitizer/catalyst choice:

There is no universal catalyst for microwave treatment of a blend of waste plastics which are randomly mixed having different compositions;

Heteroatoms, especially the halogen atoms and sulfur, which are commonly found in a waste plastic mixture may poison any catalyst;

The additives used to bind the heteroatoms, may require a higher temperature for their functioning than the temperature of hydrocarbon cracking since the energy of C—C bond rupture is usually lower than the C—X bond energy (X is a heteroatom);

Since it is difficult to separate or recover the catalyst material from carbonized waste, it will be disposed of except for a relatively small fraction which may be recycled in the process. This restriction limits utilization of a number of commercial catalysts in the contemplated microwave process.

Examples of suitable sensitizers/catalysts include:

1. $\gamma$-$Al_2O_3$ which contains 10 to 70 wt % of $Fe_3O_4$

2. ZSM-type crystalline zeolite having the composition of (x) $M_2O$:(y) $Al_2O_3$:(z) $SiO_2$, where x=0.2 to 0.5; y=1.0; z>6; and M is an alkali metal cation.

3. An exchange product of a sodium zeolite (4.0 wt % $Na_2O$) with La to a content of 1 to 5 wt %, calcining, and by further exchanging with Sr to a content of 0.3 wt %.

4. Calcium oxide with 10 wt % of a Group VIB metal oxide (chromium, molybdenum, and tungsten) or their mixtures. Before use, the catalyst is calcined in air at 500° C.

5. A mixture of clay with 5 wt % magnesia and 3 wt % sodium silicate, treated with a 10% solution of NaOH, dried and calcined.

6. Gamma-alumina pellets impregnated with nickel by soaking them in a nickel salt solution which is dried (an operation which can be repeated to obtain the required nickel content) and then calcined at 550° C.

7. A porous inorganic support impregnated with a metal salt which is decomposed thermally and, if necessary, reduced with hydrogen. Alternatively, the metal catalysts can be obtained by chemical vapor deposition (CVD) techniques by decomposing volatile organometallic compounds.

8. Pulverized slags from the metal plants. Examples of such materials from a Pierce-Smith copper converter and tin-extraction slags are provided in the following tables:

Average Copper Converter Slag Composition

| Component | Concentration wt % |
|---|---|
| Silica | 35 |
| Iron Oxide ($Fe_3O_4$) | 20 |
| Iron Oxide ($Fe_2O_3$) | 35 |
| Copper ($Cu_2O$) | 3.5 |
| Lead (PbO) | 0.5 |
| Zinc | 1.0 |
| Bismuth | 0.05 |
| Antimony | 9.05 |
| Arsenic | 0.05 |

Composition Ranges of Tin-Extraction Slags

| Component | Concentration wt % |
|---|---|
| Silica | 25 to 40 |
| Alumina | 5 to 15 |
| Lime | 10 to 20 |
| Iron Oxide | 15 to 40 |
| Tin (SnO) | 8 to 18 |

In summary, the sensitizer for use herein is a material which exhibits high dielectric loss at microwave and radio frequencies. The sensitizer may be activated carbon (pellets or powder), coal, transition metal oxides such as NiO, CuO, etc., or supported metal catalysts which are obtained by impregnating a high surface area support material (silica, $\gamma$-alumina, zeolite, activated carbon, etc.) by a transition metal salt or mixtures of such salts, with or without subsequent treatment (e.g. hydrogen reduction). It is important for the material of the sensitizer to have a moderate electrical conductivity to provide a good coupling with the microwaves. The sensitizer concentration is chosen empirically since the interaction of microwave/radio frequency energy with the plastics/sensitizer composite depends on the individual dielectric constants of the components, the way they are mixed or distributed, the shape of the load, the temperature, and the conversion or degree of decomposition. A typical range of the sensitizer concentration is from 1 to 60 wt %, depending on the density and shape of the sensitizer and its position in the applicator. The sensitizer may also exhibit catalytic properties in the microwave cracking process.

A few examples of sensitizers are:

1. Activated carbon powder, average size 20 to 60 micrometers;

2. Activated carbon pellets, 1 mm in diameter, 5 mm long;

3. Activated carbon impregnated with a solution of nickel nitrate ($Ni(NO_3)_2$), then dried and calcined in a flow of inert gas (nitrogen). The catalyst/sensitizer can contain NiO (from 20 to 60 wt %).

4. As noted above, natural minerals and ores containing transition metal ions, steelmaking slags or metal plant wastes can be used as catalysts or sensitizers in the plastic material cracking. These materials include $Ni_2O_3$, NiO, $Fe_2O_4$, $Co_2O_3$, CuO, etc.

As further noted above, a number of low grade transition metal ores (for example, minerals containing nickel oxides) can be used as catalysts. It was demonstrated that microwave or radiofrequency irradiation of a mixture of such ores with a carbon source initiated reduction of the oxide to metal. With this approach, poisoning the active sites of the catalyst will not be critical for the process since there will be a constant supply and generation of active catalyst with the feed material. In addition to well known catalytic properties of nickel in organic reactions, it was also shown that Ni on carbon and other supports, catalyzes hydrodechlorination and dehydrochlorination of chlorinated organic waste streams.

Additives can be used to reduce or eliminate toxic contamination in products such as sulfur or HCl. They may consist of CaO, granulated limestone and other forms of $CaCO_3$.

As a preferred embodiment, the contemplated microwave cracking process is carried out with a carbon sensitizer. Since the residue from depolymerization and cracking mainly consists of a solid carbonized material and coke, some fraction of this material will be recycled as sensitizer. A mulling mill can be provided to pulverize the carbon residue before mixing it with the plastics feed to provide uniform distribution of the sensitizer through the processing material. Since most plastics are dielectrics, variations in their composition will not significantly influence the dielectric loss function. A major factor regarding microwave absorption will be determined by the concentration and structure of the sensitizer.

The present invention contemplates using single mode, traveling mode and multimode microwave applicators. Usually, the multimode type is the most widely used microwave applicator, although heating uniformity is frequently a problem. The load influences the mode spectral density in the multimode cavity. With high dielectric loss materials, the performance of multimode applicators or traveling mode applicators is usually better than with single mode cavities. However, single mode resonant cavities provide much higher electric field strength than a traveling wave or multimode applicator, which is important in microwave activated cracking.

Figure 1B:
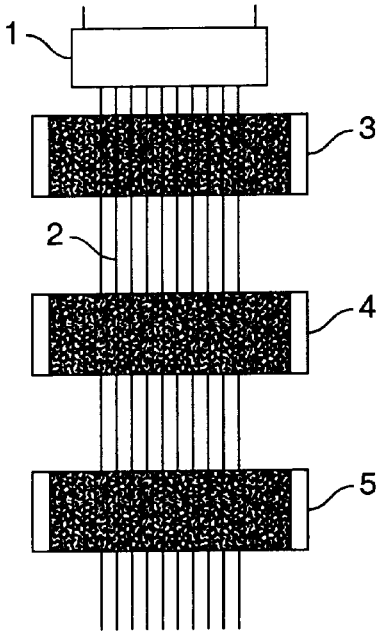

Justification for choosing a particular type of reactor is based on the dielectric characteristics of the processing material and experimental data obtained with the reactor prototype. Application of radiofrequency is also contemplated. Two types of RF applicators are shown as FIGS. 1A and 1B, namely, a plate capacitor (FIG. 1A) and ring electrodes structure (FIG. 1B). As was mentioned above, the dielectric characteristics of the processed material changes along the reactor, so that adjustments in the distribution of electromagnetic power density inside the reactor is provided.

Figure 4:
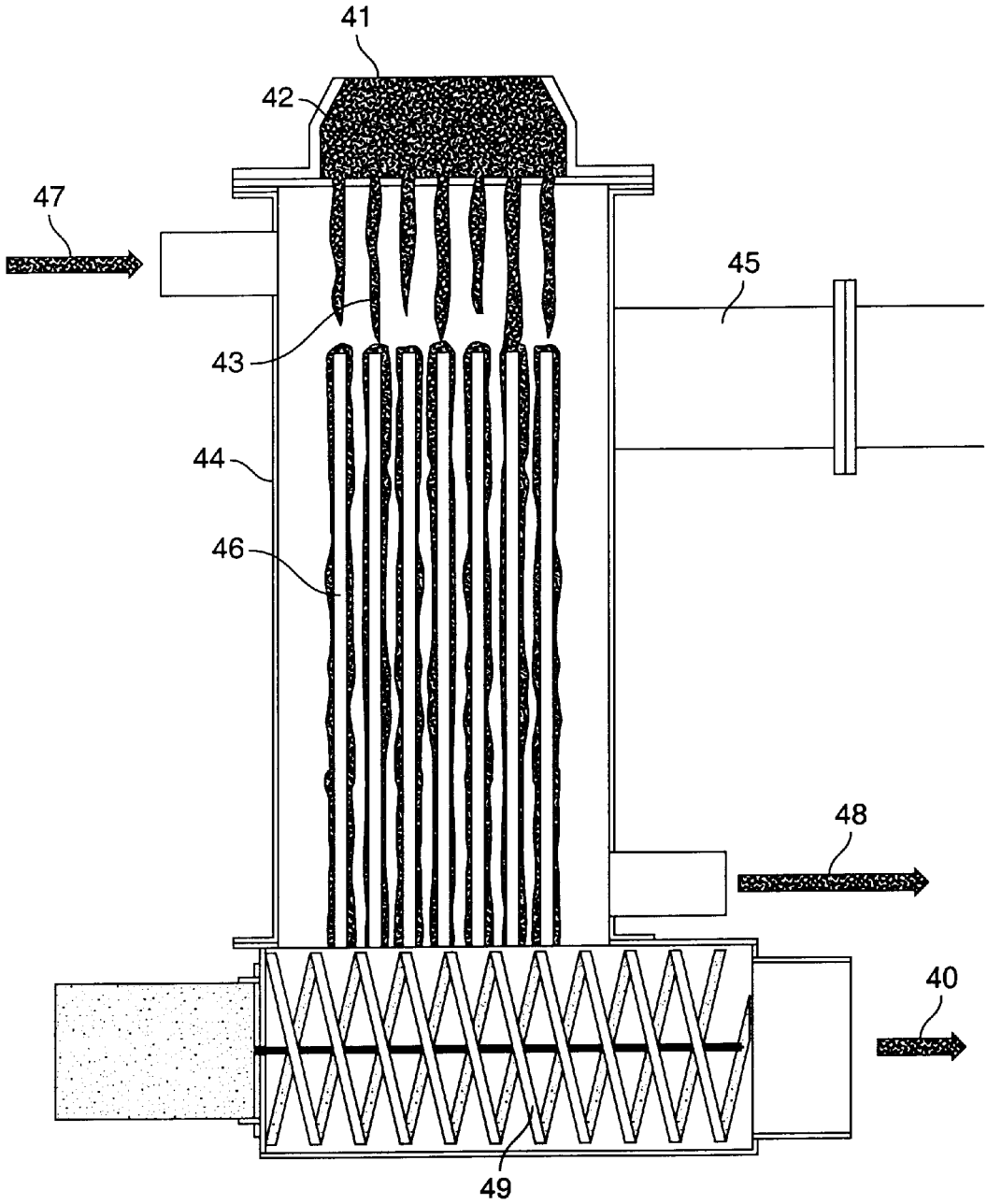
Figure 5:
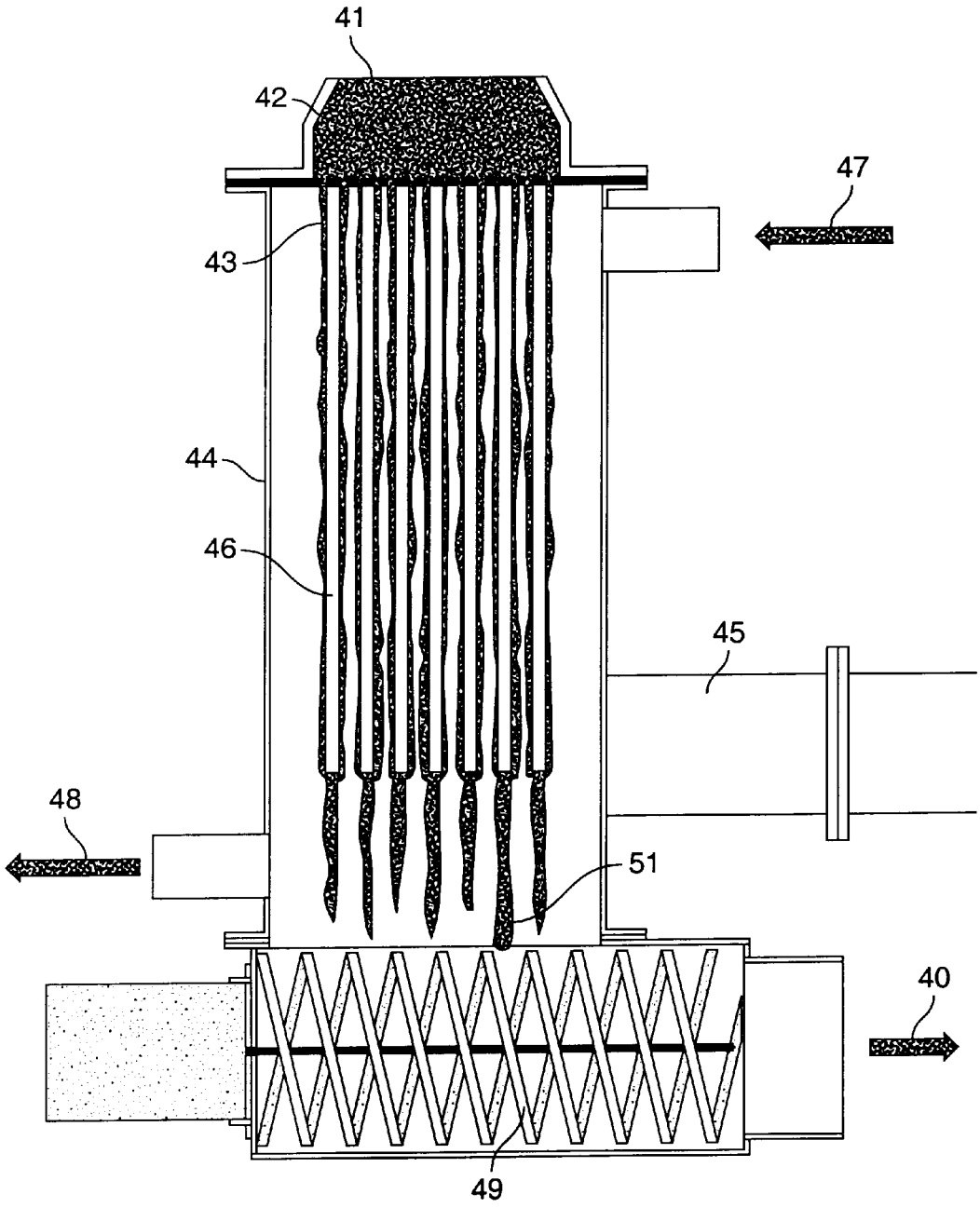

A schematic diagram of the microwave cracking reactor contemplated for use herein is shown in FIGS. 4 and 5. The design includes a single-mode or multi-mode cavity 44, traveling mode applicator 45 or other type of microwave applicator, or a radio frequency applicator with the plate or ring electrodes (antennas). An extruder 41 is mounted at the top of the reactor to produce "spaghetti" strands or thin sheets 43. The molten plastic is extruded through the holes in a disk 42 mounted at the top of the reactor. A carrier gas inlet 47 is shown as well as a product outlet of a mixture of gaseous and vapor products with the carrier gas. Screw conveyor is also shown to move the created carbonized waste which outlets the system at 40.

Depending on the stability of the strands, there could be the reactor designs as follows: (i) microwave/RF cavity without supporting rods or plates; (ii) a cavity with the supporting rods/plates mounted at the bottom of the reactor (FIG. 4) so that the first stage of microwave activated cracking takes place when the plastic material is extruded into the reactor and undergoes depolymerization before contacting the supporting rods/plates; (iii) a cavity with the supporting rods/plates 46 mounted at the top of the reactor (FIG. 5) so that the extruded material is moving down along the supporting rods/plates and the first stage of microwave activated cracking takes place on the surface of the supporting structure; cracking of the highly carbonized feedstock takes place below the supporting structures so that the coke deposition on the rods/plates is minimized; (iv) if necessary, a gap approximately 10 to 20 mm is provided in the middle of the rods, facilitating generation of the microwave discharges.

Figure 2:
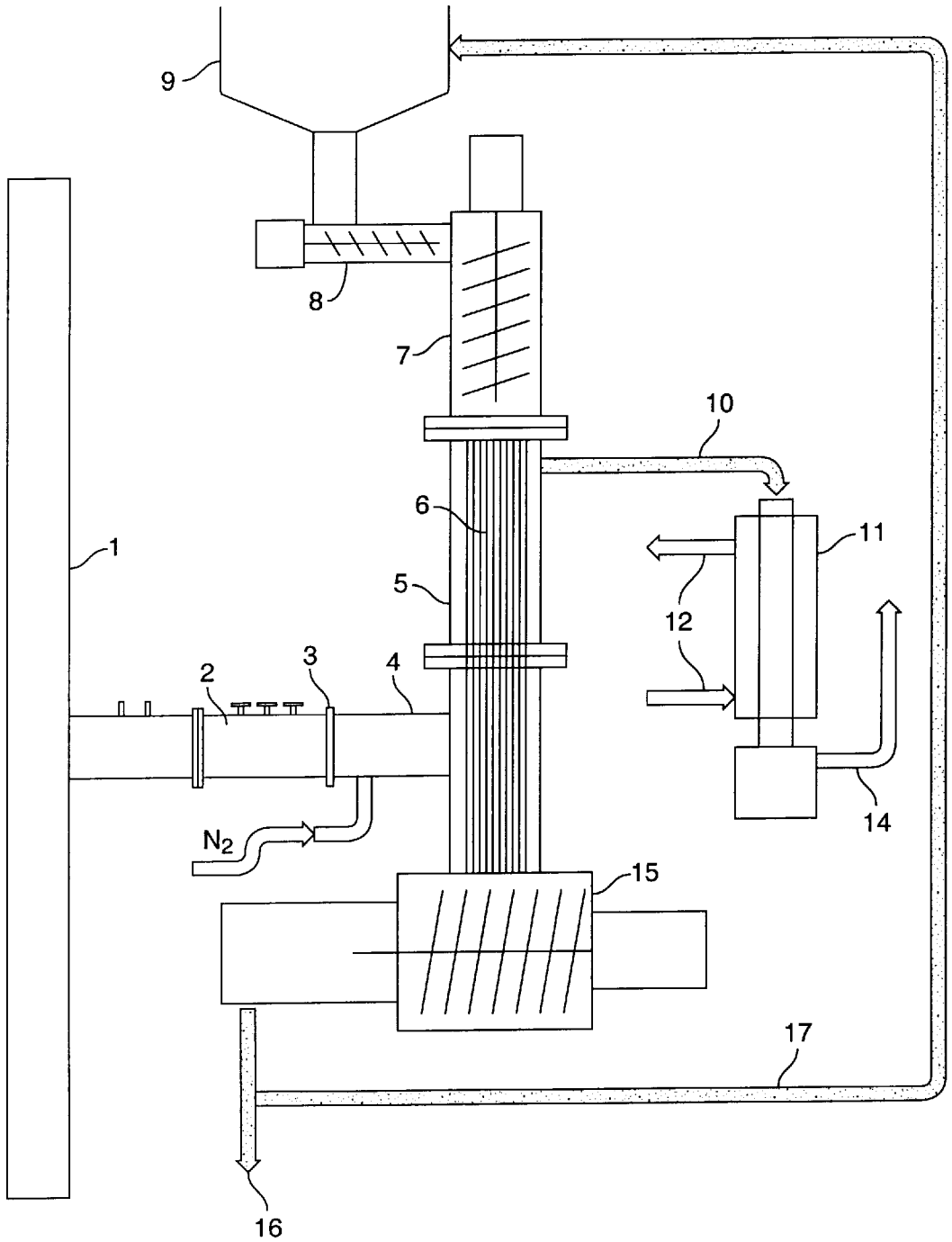
Figure 6:
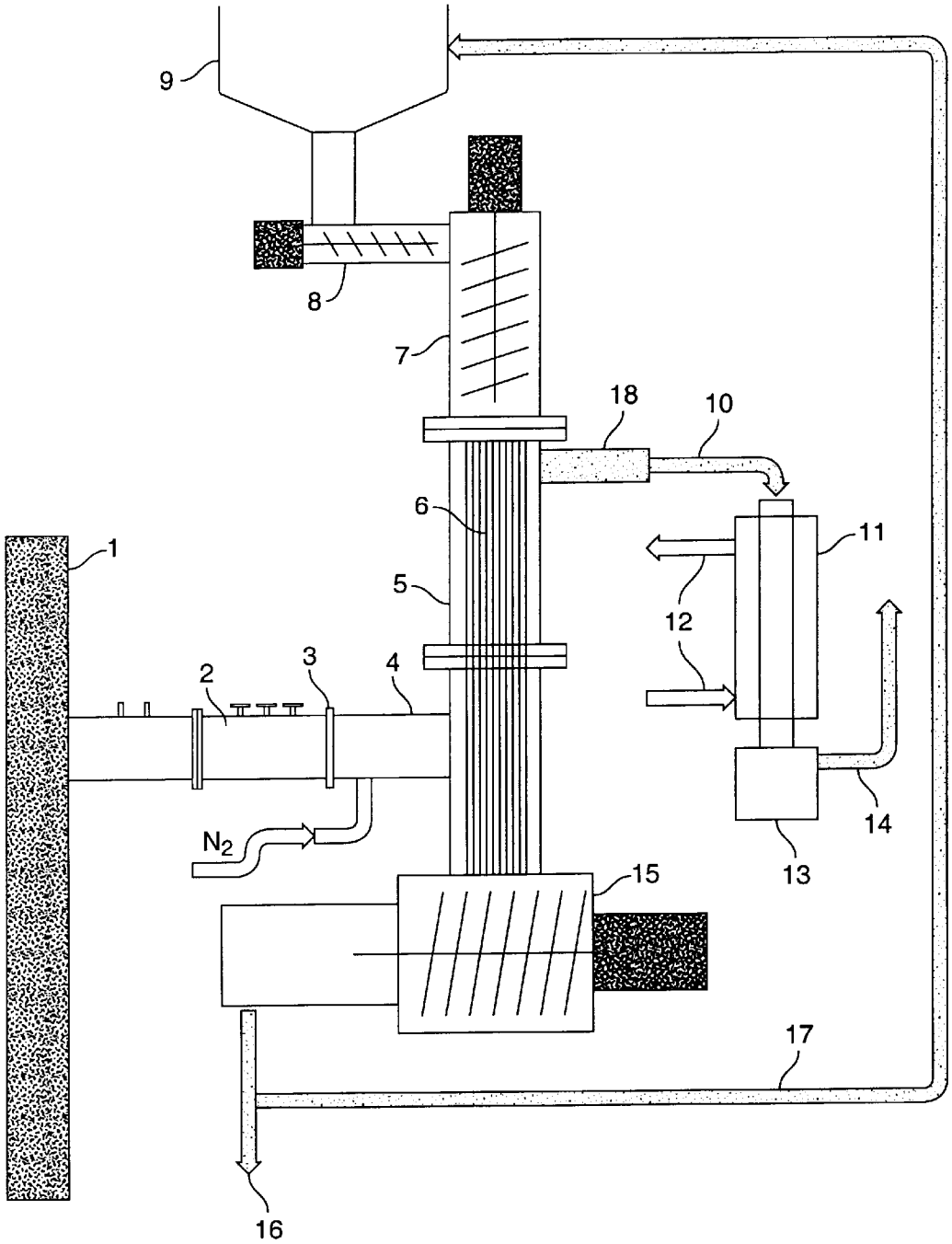

FIGS. 2 and 6 illustrate schematics of typical installations used in practicing the present invention although a range of frequencies can be employed. Like numerals are used in both figures to identify common elements. In reference to FIG. 2, microwave generator 1 generally is operated at 915 MHz (15–30 kW). Stub tuner 2 is employed for reaction impedance adjustment. Quartz window 3 is employed to insulate the reactor from the wave guide including coupling between the rectangular wave guide and circular reactor noting that the wave guide section is flushed with nitrogen to provide a carrier gas for product removal and to protect the quartz window from contamination with gaseous and vapor products. Circular reactor 5 is provided with an interior diameter of any approximate dimension such as from 300 to 600 mm while microwave activated and catalytic reactions of cyclization and isomerization with heteroatoms such as S, N and Cl as noted above occurs. Extruder 7 is provided with a replaceable disk to optimize the diameter of strands 6 and to optimize selected density of distribution. Screw conveyer 8 (FIG. 2) or 65 (FIG. 3) is provided for feeding raw materials while hopper/blender 9 is employed to feed the extruder with a mixture of pulverized plastics and sensitizer/catalyst/absorber. Product outlet 10 is provided which includes a mixture of gaseous and vaporous products with a carrier gas. Cooler 11 is employed to condense liquid products while element 12 indicates the coolant inlet and outlet. Collector 13 is configured for collecting liquid products while exhaust 14 is provided for expelling non-condensable products for further processing or burning. Second screw conveyer 15 is included for carbonized waste while element 16 is provided for removal of solid waste. Finally, element 17 indicates a waste fraction which is pulverized and returned as sensitizer/catalyst back to hopper 9.

Figure 3:
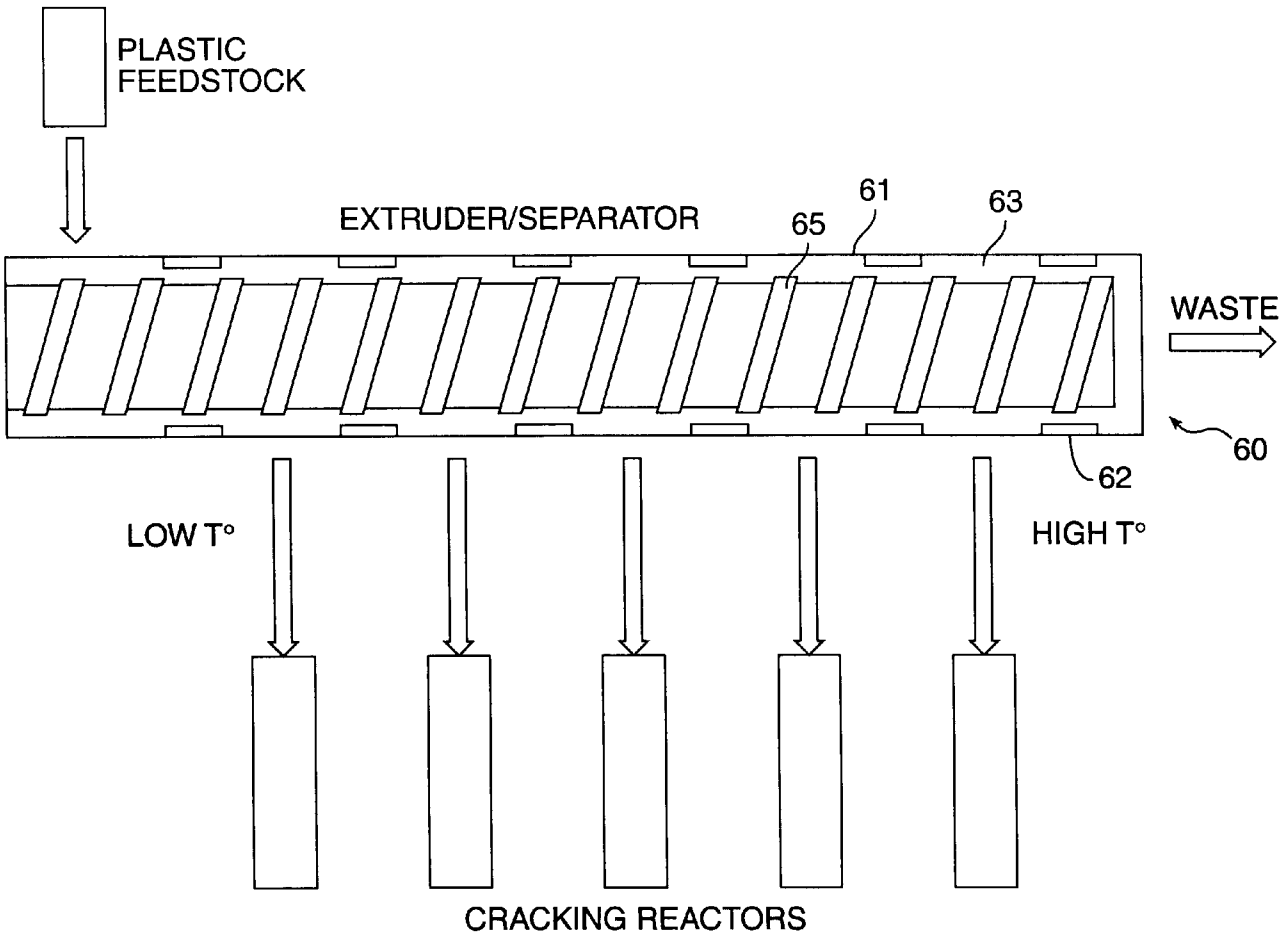

Turning to FIG. 3, the process described in FIG. 2 can be modified by installing an additional catalytic unit 18 inside or outside of the microwave reactor. The unit contains a reforming catalyst to upgrade the product value and activated by supplying microwave energy from the main microwave generator or an additional generator. As an option, the temperature of the catalyst may be controlled by conventional heating. The purpose of the catalytic unit is to increase the selectivity of the process with respect to particular products or to convert the primary products of microwave cracking into different products.

Utilization of the catalytic unit allows efficient utilization of more expensive or poison-sensitive catalysts to be implemented due to the following conditions:

Only volatile products react on the surface of the catalyst in the catalytic unit.

The heteroatoms-containing catalytic poisons are bound with the additives in the main stream of the molten plastic/sensitizer/additive mixture. They remain in the molten processed material and then in the solidified carbonized waste.

Some hydrocarbon molecules may vaporize by thermal cracking before contact with the catalyst for the molten material may not be contacted with the catalyst long enough for the complete conversion or the contacted catalyst may be deactivated or poisoned. These molecules require additional processing catalytic stage for obtaining required final products.

Some fraction of the primary plastic pryolysis products may have a high molecular weight. This material could condense in the form of wax at cold parts or in the outlet port of the reactor. Installation of the additional catalytic converter eliminates this problem and increases the product value.

The catalyst in the additional catalytic unit can be easier reactivated and recycled. The deactivated catalyst in the solidified (carbonized waste) will contain the products of reactions of the additives with heteroatoms and coke, so that the technology for its regeneration may be expensive or the recycling be non-practical.

The reactor can be modified in such a way that the product outlet is at the top of the reactor or at the bottom, or at any height, or there are a number of ports to collect the products.

In most installations, the waste feed contains non-plastic contaminants such as paper labels, pieces of metal and wood, etc. The plastic material is non-uniform and contains various compositions of polymers which undergo different cracking reactions. Some of these reactions require different catalysts for different polymers and different additives, for example, polyvinyl chloride which under pyrolysis conditions evolves hydrogen chloride which is usually reacted with an additive such as $CaCO_3$; no such additives are required in thermal/catalytic cracking of polyethylene, polypropylene, polystyrene, and other hydrocarbon polymers.

To optimize the cracking reactions and separate non-plastic contaminants from the plastic material, the microwave reactors are connected to an extruder/separator as shown in FIG. 3. The feeder utilizes differences in the physical properties of the feed components in order to separate them. In the scheme shown in FIG. 3, the main extruder 61 serves as a separator. The extruder consists of sections which have holes 62 in the wall 63. The diameter of the holes, their location and distribution allow the molten plastics to be extruded out whereas the solid pieces and particles remain inside the extruder. Non-plastic material in the feed (paper labels, pieces of metal, wood, fabric, glass, etc.) will be removed at the end 64 of the extruder since it does not go through holes 62. The main screw conveyor 65 has blades which clean the holes and remove plugging material. The plastic material extruded at a particular section of the main screw is mixed with specific catalysts and additives and fed into a separate cracking reactor. In some applications, the material extruded at different sections is mixed together and processed in one reactor.

Feed plastic material which is mixed with a sensitizer, catalyst and additive, is extruded into the reactor in the form of strands 6, sheets, etc., as shown in FIG. 2 in order to increase the surface area and make the material thickness be of the range of the penetration depth for the microwave/radio frequency power. In the reactor, the material undergoes thermal/catalytic cracking under microwave irradiation. During this process, the molecular weight of the polymers is reduced several orders of magnitude. As a result of the high temperature and depolymerization, the material viscosity becomes low so that utilization of supporting devices such as rods or plates may be necessary to increase the residence time of the process material inside the reactor and to achieve higher conversions. Such rods and/or plates can be made of dielectric material such as alumina and positioned vertically or at some angle with respect to the reactor axis. The rods are wetted with the melted plastic composite which moves down by gravity and decomposes to give volatile products and non-volatile residue. The reactor length is chosen in such a way that it provides a residence time sufficient for a high conversion (80% to 90%) of the plastics. The cracking process is completed at the bottom of the reactor The dielectric characteristics of the reactor load may slowly be changing due to deposition of the coke on the surface of the ceramic rods. Deposited coke can be removed by passing air flow through the reactor under microwave irradiation. The coke is oxidized by oxygen giving rise to carbon oxides and water vapor.

If necessary, a narrow gap (5 to 10 mm) may be provided in every rod. The gaps are located in the region of high density electromagnetic field and will facilitate generation of microwave discharges which increases generation of the free radicals in the system under consideration.

Turning again to FIG. 2, liquid and gaseous products are separated by using a cooler/condenser. The degree of conversion is gradually increasing as the feed material moves from the top of reactor to the bottom. When the microwave reactor operates at steady-state conditions, the conversion achieved at a given distance from the top of the reactor, is a constant with respect to the time. The product composition may change with the conversion (for example, the first stage in the polyethylene and polypropylene cracking is depolymerization with a minimum liberation of volatile products; the major primary products are obtained at the second stage which is followed by decomposition of non-volatile primary products at a higher degree of conversion). It is proposed to provide a number of product outlets along the reactor in order to separate the products produced at different stages of the microwave cracking.

The gaseous products may contain methane which has a low value, and hydrogen. Since hydrogen (and methane under some conditions) may participate in the free radical reactions under microwave irradiation, it is suggested to separate them from heavier hydrocarbon products and re-circulate them into the system as carrier gas.

Consumption of the microwave energy may be reduced by adding small amounts of oxygen or nitrous oxide below the explosion limit. The oxidant will participate in the free radical reactions providing additional energy to the system. Initiation of the free radical chains is facilitated by the microwave irradiation. Since the oxidant is added at a concentration below the explosion limit, the reactor operation is safe and under control. In this regard, oxygen concentration is usually limited to below approximately 2% by volume.

The carbonized hydrocarbon waste contains the sensitizer and deactivated catalyst as well as the reacted additive for binding heteroatoms. As noted above, some fraction of the carbonized material is re-circulated as the sensitizer since it has a high fraction of carbon and a high dielectric loss factor. The rest of the waste is generally disposed of. However, the total volume of the solid waste is significantly lower than that of the feed material since most of its weight is extracted as low molecular weight products.

The following examples illustrate the carrying out of the present invention.

EXAMPLE I

An experimental reactor consisting of a stainless steel cylindrical cavity which is mounted vertically (FIG. 2) was provided. Microwave power at the frequency of 915 MHz was supplied into the reactor through a rectangular waveguide from a microwave generator operating at a power level of up to 30 kW. The top flange of the reactor accommodates a stainless steel disk with holes 3 mm in diameter for extruding mixed plastic material into the reactor. As noted above, the hole diameter allows for achieving a high surface area for the extruded material having a material thickness of the order of the penetration depth of the microwaves. An extruder was mounted above the disk with holes to supply the feed material into the reactor.

A mixture of plastic materials were fed into the reactor consisting of low density polyethylene (35 wt %), high density polyethylene (20 wt %) polypropylene (20 wt %), polystyrene (5 wt %), and a carbon-based sensitizer (20 wt %). The sensitizer was composed of 15 wt % of NiO deposited on activated carbon. The temperature in the extruder was 270 to 290° C. The plastics feed rate was 55 kg/h.

Due to high temperatures which developed in the plastics under microwave irradiation (of the order of 500 to 600°), depolymerization of the high molecular weight molecules took place. As a result of high temperature and depolymerization, the material viscosity became low and the extruded "rods" or "spaghetti" broke before a complete decomposition took place.

As noted above, to increase the residence time of the processing material inside the reactor and to achieve high conversion, supporting rods were provided. The rods were 3 mm in diameter and of the height of the reactor and consisted of an alumina ceramic. The rods were positioned below the holes in the top disk so that the molten plastics/sensitizer composite is moved down along the ceramic rods by gravity. The length of the reactor was chosen in such a way that it provided a residence time sufficient for high conversion (80% to 90%) of the plastics. The cracking process was completed at the bottom of the reactor where the residue containing significantly higher fractions of coke and high carbon molecules had a high dielectric loss factor and thus more efficiently absorbed the microwaves resulting in higher temperatures. The residue also contained particles of the catalyst/sensitizer.

A screw conveyor was installed at the bottom of the reactor, which crushed the solidified residue (coke mixed with the sensitizer/catalyst) and removed it from the reactor. The rotation speed of the screw was adjusted to the feed rate so that the process proceeded under steady-state conditions with the dielectric characteristics mainly a function of the position inside the reactor which do not change with time.

The reactor was constantly flushed with a flow of nitrogen to remove the cracking products.

After turning on the extruder feeding the plastic material mixture into the reactor, microwave power was applied at a power level of 30 kW. Due to the high temperatures developed in the processed material exposed to microwave radiation and microdischarges along the streams of the molten composite, cracking of the polymer molecules took place giving rise to gaseous and vapor products. The composition of the products collected after cooling is as follows:

| PRODUCT | YIELD, WT. % |
|---|---|
| methane | 15 |
| ethane | 8.2 |
| ethylene | 35 |
| acetylene | 0.5 |
| propane | 5.5 |
| propylene | 4.9 |
| $C_4$ paraffins | 5.0 |
| $C_4$ olefins | 7.1 |
| benzene | 7.2 |
| toluene | 5.6 |
| other hydrocarbons | 6 |
| TOTAL | 100 |

EXAMPLE II

The reactor set-up was the same as in Example I. The plastics mixture consisted of low density polyethylene (25 wt %), high density polyethylene (15 wt %), polypropylene (12 wt %), polystyrene (10 wt %), polyethylene terephthalate (8 wt %), a carbon-based sensitizer (20 wt %), and catalyst (10 wt %). The sensitizer was as described in Example 1. The catalyst was a ZSM-type crystalline zeolite having the composition of 0.4 $Na_2O:Al_2O_3:8\ SiO_2$. The temperature in the extruder was 290 to 300°.

Under the 30 kW microwave irradiation, the plastics in the feed material was cracked giving rise to the following products:

| PRODUCT | YIELD WT % |
|---|---|
| methane | 11 |
| ethane | 6.2 |
| ethylene | 33 |
| acetylene | 0.8 |
| propane | 4.3 |
| propylene | 5.1 |
| $C_4$ paraffins | 6.9 |
| $C_4$ olefins | 6.3 |

-continued

| PRODUCT | YIELD WT % |
|---|---|
| benzene | 9.7 |
| toluene | 7.0 |
| other hydrocarbons | 9.7 |
| TOTAL | 100 |

EXAMPLE III

The reactor set-up was the same as in Examples I and II. The plastics mixture consisted of low density polyethylene (25 wt %), high density polyethylene (15 wt %), polypropylene (12 wt %), polystyrene (10 wt %), polyethylene terephthalate (8 wt %), a carbon-based sensitizer (20 wt %), and catalyst (10 wt %). The sensitizer and catalyst were the same as in Example II. The temperature in the extruder was maintained from 290 to 300° C.

Supporting alumina rods were used having a 10 mm gap in the middle of the reactor, which facilitated the development of microdischarges during irradiation. Under 30 kW microwave irradiation, the plastics in the feed material were cracked giving rise to the products presented as follows:

| PRODUCT | YIELD WT % |
|---|---|
| methane | 11 |
| ethane | 5.9 |
| ethylene | 36 |
| acetylene | 0.9 |
| propane | 4.4 |
| propylene | 5.2 |
| $C_4$ paraffins | 5.6 |
| $C_4$ olefins | 6.2 |
| benzene | 9.9 |
| toluene | 6.8 |
| other hydrocarbons | 8.1 |
| TOTAL: | 100 |

EXAMPLE IV

The reactor set-up was the same as in Example III. The plastics mixture consisted of low density polyethylene (25 wt %), high density polyethylene (15 wt %), polypropylene (12 wt %), polystyrene (10 wt %), polyethylene terephthalate (8 wt %), a carbon-based sensitizer (20 wt %), and catalyst (10 wt %). The sensitizer and catalyst were the same as in Example 2. The temperature in the extruder was maintained from 290 to 300° C.

The reactor was flushed with a flow of nitrogen containing 2% of oxygen. During microwave irradiation, the temperature of the plastic material mixed with catalyst and sensitizer was increased up to 600 to 700° C. The microdischarges generated at the surface of the plastic streams initiated free radical reactions of the polymer molecules and created products resulting from their decomposition. Participation in these reactions of oxygen which is added into the reactor, increased the temperature of the processed material and yield of the products. The product yields were as follows:

| PRODUCT | YIELD WT % |
|---|---|
| methane | 11 |
| ethane | 5.4 |
| ethylene | 44 |
| acetylene | 0.4 |
| propane | 5.3 |
| propylene | 6.1 |
| $C_4$ paraffins | 5.9 |
| $C_4$ olefins | 4.7 |
| benzene | 8.8 |
| toluene | 5.9 |
| other hydrocarbons | 6.5 |
| TOTAL: | 100 |

EXAMPLE V

The reactor set-up was the same as in Example I. The plastics mixture consisted of low density polyethylene (20 wt %), high density polyethylene (15 wt %), polypropylene (10 wt %), polystyrene (15 wt %), polyethylene terephthalate (5 wt %), poly(vinyl chloride) (5 wt %), a carbon-based sensitizer (20 wt %), a catalyst (5 wt %) and calcium carbonate (5 wt %). The sensitizer was activated carbon while the catalyst was obtained by mixing clay with 5 wt % of magnesia and 4 wt % sodium silicate, then treated with a 10% solution of NaOH, dried and calcined. Calcium carbonate was added to react with hydrogen chloride evolving due to decomposition of poly(vinyl chloride). The temperature in the extruder was 290 to 300° C. The reactor was flushed with a flow of nitrogen. The product yield was as follows:

| PRODUCT | YIELD WT % |
|---|---|
| methane | 6.1 |
| ethane | 4.6 |
| ethylene | 13 |
| acetylene | 0.2 |
| propane | 7.3 |
| propylene | 5.1 |
| $C_4$ paraffins | 4.9 |
| $C_4$ olefins | 5.3 |
| benzene | 15 |
| toluene | 13 |
| ethylbenzene | 5.4 |
| styrene | 12 |
| $C_9$ aromatics | 0.8 |
| other hydrocarbons | 7.3 |
| TOTAL: | 100 |

EXAMPLE VI

The reactor set-up was the same as in Example I. The plastics mixture consisted of low density polyethylene (20 wt %), high density polyethylene (15 wt %), polypropylene (10 wt %), polystyrene (15 wt %), polyethylene terephthalate (5 wt %), poly(vinyl chloride) (5 wt %), a carbon-based sensitizer (20 wt %), a catalyst (5 wt %) and calcium carbonate (5 wt %). The sensitizer and catalyst were as in Example V. Calcium carbonate was added to react with hydrogen chloride evolving due to decomposition of poly (vinyl chloride). The temperature in the extruder was 290 to 300° C. The reactor was flushed with a flow of gas containing nitrogen (20 Vol %), methane (60 vol %) and hydrogen (20 vol %). The product yield was as follows:

| PRODUCT | YIELD WT % |
|---|---|
| ethane | 4.1 |
| ethylene | 10 |
| acetylene | 0.4 |
| propane | 7.4 |
| propylene | 4.6 |
| $C_4$ paraffins | 4.1 |
| $C_4$ olefins | 5.0 |
| benzene | 17 |
| toluene | 15 |
| ethylbenzene | 5.8 |
| styrene | 16 |
| $C_9$ aromatics | 0.8 |
| other hydrocarbons | 9.8 |
| TOTAL: | 100 |

With microwave activation, the cracking process of plastic and cellulosic materials may be facilitated by adding bitumens which mainly consist of polyaromatic molecules. Bitumens and tars are moderately susceptible to microwave radiation. It has been shown [1] that application of microwave induced catalytic techniques to decompose the complex and viscous hydrocarbon compounds contained in these materials allow efficient extraction of volatile and economically useful organic products such as C2 and C3 hydrocarbons.

[1] The term "Weight loss" corresponds to the conversion of initial reagents (feed) in the case of individual compounds. In the case of a mixture of compounds, it is appropriate to use a more general term "weight loss" since the components may react at different reaction rates.

The following experiments were conducted with bitumen (Cold Lake Bitumen, Alberta, Canada; contains: saturates 16.6%, aromatics 39.2%, polar compounds 24.9%, asphaltenes 19.3%, and trace amounts of other compounds.)

EXAMPLE VII

PS 80% wt., bitumen 15% wt., activated carbon 5% wt., residence time 10 min., total time of microwave irradiation (1 kW, 2450 MHz) 2 hours. The products were: ($C_1$–$C_5$) hydrocarbons 14%, ($C_6$–$C_{10}$) 40% ($C_{11}$–$C_{20}$) 46%. Weight loss 31%[1].

EXAMPLE VIII

Bitumen 15% wt., PS 40% wt., wood dust 40% wt, activated carbon 5% wt. residence time 10 min., total time of microwave irradiation (1 KW, 2450 MHz) 2 hours. The products were: ($C_1$–$C_5$) hydrocarbons 15% ($C_6$–$C_{10}$) 36% ($C_{11}$–$C_{20}$) 49%. Weight loss 38%.

EXAMPLE IX

Bitumen 15% wt., PVC 50% wt., wood dust 25%, $H_2O$ 5% wt., activated carbon 5% wt. residence time 10 min., total time of microwave irradiation (1 kW, 2450 MHz) 2 hours. The products were: ($C_1$–$C_5$) hydrocarbons 21% ($C_6$–$C_{10}$) 9% ($C_{11}$–$C_{20}$) 30%. Weight loss 40%.

EXAMPLE X

LDPE 80% wt., bitumen 15% wt., activated carbon 5% wt., residence time 10 min., total time of microwave irradiation (1 kW, 2450 MHz) 2 hours. The products were ($C_1$–$C_5$) hydrocarbons 19% ($C_6$–$C_{10}$) 29% ($C_{11}$–$C_{20}$) 52%. Weight loss 40%.

EXAMPLE XI

LDPE 80% wt., bitumen 15% wt., activated carbon 5% wt., residence time 5 min., total time of microwave irradiation (1 kW, 2450 MHz) 2 hours. The products were ($C_1$–$C_5$) hydrocarbons 5% ($C_6$–$C_{10}$) 18% ($C_{11}$–$C_{20}$) 77%. Weight loss 35%.

EXAMPLE XII

LDPE 79% wt., bitumen 15% wt., NiO 1% activated carbon 5% wt., residence time 10 min., total time of microwave irradiation (1 kW, 2450 MHz) 1.3 hours. The products were ($C_1$–$C_5$) hydrocarbons 32% ($C_6$–$C_{10}$) 19% ($C_{11}$–$C_{20}$) 49%. Weight loss 35%.

EXAMPLE XIII

LDPE 79% wt., bitumen 15% wt., NiO 1% activated carbon 5% wt., residence time 10 min., total time of microwave irradiation (1 kW, 2450 MHz) 0.8 hours. The products were ($C_1$–$C_5$) hydrocarbons 16% ($C_6$–$C_{10}$) 38% ($C_{11}$–$C_{20}$) 46%, weight loss 19%.

EXAMPLE XIV

LDPE 80% wt., bitumen 15% wt., activated carbon 5% wt., residence time 10 min., total time of microwave irradiation 1 hour. The products were ($C_1$–$C_5$) hydrocarbons 28% ($C_6$–$C_{10}$) 25% ($C_{11}$–$C_{20}$) 47%, weight loss 37%.

EXAMPLE XV

80% wt. LDPE, 20% bitumen, residence time 10 min., total time of microwave irradiation (1 kW, 2450 MHz) 1 hour. The products were ($C_1$–$C_5$) hydrocarbons 0.5% ($C_6$–$C_{10}$) 16.5% ($C_{11}$–$C_{20}$) 83%, weight loss 21%. The following experiments were carried out without extruder:

EXAMPLE XVI

100% bitumen; total time of microwave irradiation (1 kW, 2450 MHz) is 1.5 hour. The products were: ($C_1$–$C_5$) hydrocarbons 0.5% ($C_6$–$C_{10}$) 41.5% ($C_{11}$–$C_{20}$) 58%, weight loss 3.1%.

EXAMPLE XVII

5% activated carbon, 20% bitumen; total time of microwave irradiation (1 kW, 2450 MHz) is 40 minutes. The products were: ($C_{1-C5}$) hydrocarbons 27% ($C_6$–$C_{10}$) 24% ($C_{11}$–$C_{20}$) 49%, weight loss 2.5%.

EXAMPLE XVIII

80% LDPE, 20% bitumen; total time of microwave irradiation (1 kW, 2450 MHz) is 1 hour. The products were: ($C_1$–$C_5$) hydrocarbons 0.4% ($C_6$–$C_{10}$) 16% ($C_{11}$–$C_{20}$) 83.6%, weight loss 1.9%.

To summarize, the present invention deals with the process of activated cracking of high molecular organic waste material which includes confining the organic waste material in a reactor space as a mixture with a pulverized electrically conducting material (sensitizer) and/or catalysts and/or "upgrading agents" and treating this mixture by microwave or radio frequency electromagnetic radiation. The "upgrading agent" can consist of calcium oxide or calcium carbonate and/or other reagents capable of reacting with heteroatoms in the feed waste material to increase the value of such product. It is contemplated that such organic waste materials consist of hydrocarbons or their derivatives, polymers or plastic materials and shredded rubber. The shredded rubber can be the source of the sensitizer and/or catalyst material as it is rich in carbon and other metallic species. This sensitizer can also consist of pulverized coke or pyrolytically carbonized organic feedstock and/or highly dispersed metals and/or other inorganic materials with high dielectric loss which absorb microwave or radio frequency energy. The catalyst consists of dispersed metal powder or dispersed metal particles supported on a high surface area organic material and/or a high surface area inorganic material impregnated with salts or coordination compounds of transition metals.

We claim:

1. A method of converting polymer hydrocarbon waste to burnable sources of energy comprising admixing said polymer hydrocarbon waste with a sensitizer and subjecting the polymer hydrocarbon waste-sensitizer combination to exposure to microwave energy.

2. The method of claim 1 wherein said microwave energy exposure is of sufficient duration and power to break down said polymer hydrocarbon waste to reduce its molecular weight and convert at least a portion of it to liquid and gas sources of energy.

3. The method of claim 1 wherein said polymer hydrocarbon waste is exposed to microwave energy in a starved oxygen environment.

4. The method of claim 3 wherein said polymer hydrocarbon waste is exposed to microwave energy in an environment having less than approximately 2% by weight oxygen.

5. The method of claim 1 wherein said polymer hydrocarbon waste comprises hydrocarbon sludges, waste plastics and automobile tires.

6. The method of claim 1 wherein said sensitizer comprises a member selected from the group consisting of amorphous carbon, amorphous and highly dispersed metals, transition metal oxides and salts.

7. The method of claim 6 wherein said sensitizers comprise amorphous metals supported by porous substrates.

8. The method of claim 7 wherein said porous substrates comprise a member selected from the group consisting of activated carbon, silica and alumina.

9. The method of claim 1 wherein said sensitizer comprises $\gamma$-$Al_2O_3$ containing approximately 10 to 70 wt % of $Fe_3O_4$.

10. The method of claim 1 wherein said sensitizer comprises (x) $M_2O$:(y) $Al_2O_3$:(z) $SiO_2$, where x=0.2 to 0.5; y=1.0; z>6; and M comprises an alkali metal cation.

11. The method of claim 1 wherein said sensitizer comprises an exchange product of a sodium zeolate with La to a content of approximately 1 to 5% by weight which has been calcined and exchanged with Sr to a content of approximately 0.3 weight %.

12. The method of claim 1 wherein said sensitizer comprises calcium oxide with approximately 10% by weight of a group VIB metal oxide and mixtures thereof.

13. The method of claim 1 wherein said sensitizer comprises a mixture of clay with approximately 5% by weight magnesia and approximately 3% by weight sodium silicate treated with an approximately 10% solution of NaOH, dried and calcined.

14. The method of claim 1 wherein said sensitizer comprises gamma-alumina pellets impregnated with nickel.

15. The method of claim 1 wherein said microwave energy is supplied by a member selected from the group consisting of single mode, traveling mode and multimode applicators.

16. The method of claim 1 further comprising the application of radio frequency energy together with said microwave energy.

17. The method of claim 1 further comprising the additions of bitumens when said polymer carbon waste is exposed to microwave energy.

18. A method of converting solid polymer hydrocarbon waste to burnable sources of energy comprising heating said solid polymer hydrocarbon waste, admixing a sensitizer with said heated polymer hydrocarbon waste to substantially uniformly disperse said sensitizer therein, extruding said polymer hydrocarbon waste-sensitizer combination and subjecting said extruded polymer hydrocarbon waste-sensitizer combination to microwave energy of sufficient duration and power to break down said polymer hydrocarbon waste to reduce its molecular weight.

19. The method of claim 18 wherein said polymer hydrocarbon waste is heated to a molten state prior to extruding said polymer hydrocarbon waste-sensitizer combination and exposing it to said microwave energy.

* * * * *